US005666095A

United States Patent [19]

Namkung et al.

[11] Patent Number: 5,666,095

[45] Date of Patent: Sep. 9, 1997

[54] HIGH POWER WAVEGUIDE VALVE

[75] Inventors: Won Namkung; Joo-Sik Park; Seung-Hwan Kim; Hee-Seob Kim; Yong-Jung Park, all of Pohang-shi, Kyongsangbuk-do, Rep. of Korea

[73] Assignee: Postech Foundation, Kyungsangbuk, Rep. of Korea

[21] Appl. No.: 622,647

[22] Filed: Mar. 26, 1996

[30] Foreign Application Priority Data

Oct. 14, 1995 [KR] Rep. of Korea ..... 95-35456

[51] Int. Cl.[6] ..... H01P 1/12

[52] U.S. Cl. ..... 333/259; 333/108

[58] Field of Search ..... 333/108, 248, 333/259

[56] References Cited

U.S. PATENT DOCUMENTS 2,396,044 3/1946 Fox ..... 333/259 X 2,825,878 3/1958 Coleman, Jr. ..... 333/259

3,697,894 10/1972 Johnson ..... 333/108

*Primary Examiner*—Paul Gensler

*Attorney, Agent, or Firm*—Anderson Kill & Olick P.C.

[57] ABSTRACT

A high power waveguide valve capable of selectively transmitting or sealing the high power without causing its breakdown during a high power operation is disclosed. The inventive high power waveguide valve includes a vacuum chamber, a U-shaped waveguide being provided in the vacuum chamber, a first linear motion driver for vertically sliding the U-shaped waveguide, a dual H-corners assembly connected with the U-shaped waveguide, a sealing plate for selectively sealing the radio frequency between the U-shaped waveguide and the dual H-corners assembly, and a second linear motion driver for horizontally sliding the sealing plate.

8 Claims, 10 Drawing Sheets

HIGH POWER WAVEGUIDE VALVE

FIELD OF THE INVENTION

The present invention relates to a waveguide valve; and, more particularly, to a high power waveguide valve.

BACKGROUND OF THE INVENTION

High vacuum all-metal waveguide valves have been in use extensively at Stanford Linear Accelerator Center ("SLAC") for more than 20 years. The original SLAC type valves used therein employed a vacuum seal and a resonant iris coupling the broad walls of parallel waveguides. The vacuum seal was achieved by forcing a circular plunger with a stepped knife-edge into an indium filled groove which was concentric with the circular coupling iris. By periodically remelting the indium, the valve seal was made reusable. The original valves worked adequately below a peak power level of about 30 MW.

There are employed in Beijing Electron Positron Collider ("BEPC") waveguide valves having a deeper seal groove and a hemispherical sealing surface instead of the knife-edge seal used in the original SLAC type valves. The vacuum seal in these valves often failed due to the indium adhering to the sealing surface, tearing the indium seal. Moreover, the sharp jagged points resulting from the indium adhesion caused radio frequency ("RF") breakdown during a high power operation.

Recently, at SLAC, a modified waveguide valve capable of overcoming the shortcomings of the original SLAC type waveguide valve has been developed. In the modified waveguide valve, the knife-edge indium seal is completely eliminated: instead an O-ring seal mechanism, which is transported to a RF-free environment during a high power operation, is employed. The continuity of wall currents on the contact surface is achieved through a shorted choke joint followed by a metal-to-metal RF seal. However, the modified waveguide valve still employs the resonant iris coupling the broad walls of the parallel waveguides and it works adequately below a peak power level of about 65 MW.

SUMMARY OF THE INVENTION

It is, therefore, a primary object of the invention to provide to a waveguide valve capable of reliably operating during a high power operation.

In accordance with one aspect of the present invention, there is provided a waveguide valve comprising; an L-shaped vacuum chamber having a top and a bottom openings; a plate for covering the top opening of the L-shaped vacuum chamber; a first actuator provided on the covering plate; a U-shaped waveguide being provided in the L-shaped vacuum chamber in such a way that it is allowed to vertically slide by the first actuator and having a connection plate provided with a pair of rectangular holes; a dual H-corners assembly having a connection plate provided with a pair of rectangular holes, each of the rectangular holes having an upper and a lower step edges, and a pair of tubes for inputting and outputting radio frequency, each of the tubes being joined to each of the lower step edges so as to be integrally formed with the dual H-corners assembly connection plate, the dual H-corners assembly connection plate covering the bottom opening of the L-shaped vacuum chamber in such a way that its rectangular holes is aligned with the corresponding U-shaped waveguide rectangular hole; a sealing plate for sealing the L-shaped radio frequency input and output tubes, the sealing plate being mounted on the dual H-corners assembly connection plate in such a way that it is allowed to horizontally slide; and a second actuator being provided with the L-shaped vacuum chamber so as to horizontally slide the sealing plate.

BRIEF DESCRIPTION OF THE DRAWINGS

The above and other objects and features of the present invention will become apparent from the following description of preferred embodiments, when taken in conjunction with the accompanying drawings, in which.

DETAILED DESCRIPTION OF THE PREFERRED EMBODIMENTS

Figure 1A:
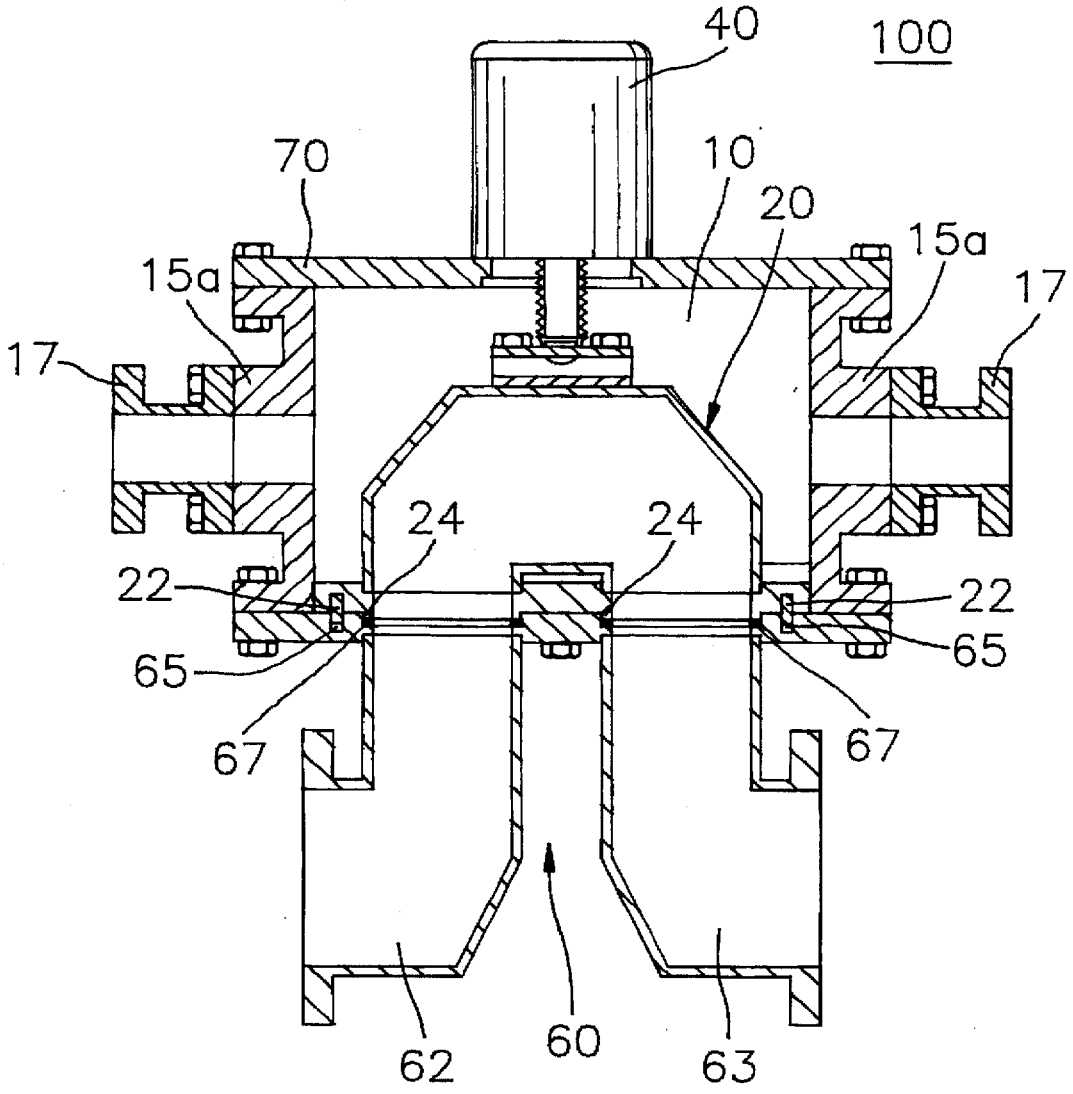
FIGS. 1A, 1B and 1C show a sectional front view, a sectional side view and a sectional top view of an inventive waveguide valve, respectively, when a high power radio frequency is applied thereto.
Figure 1B:
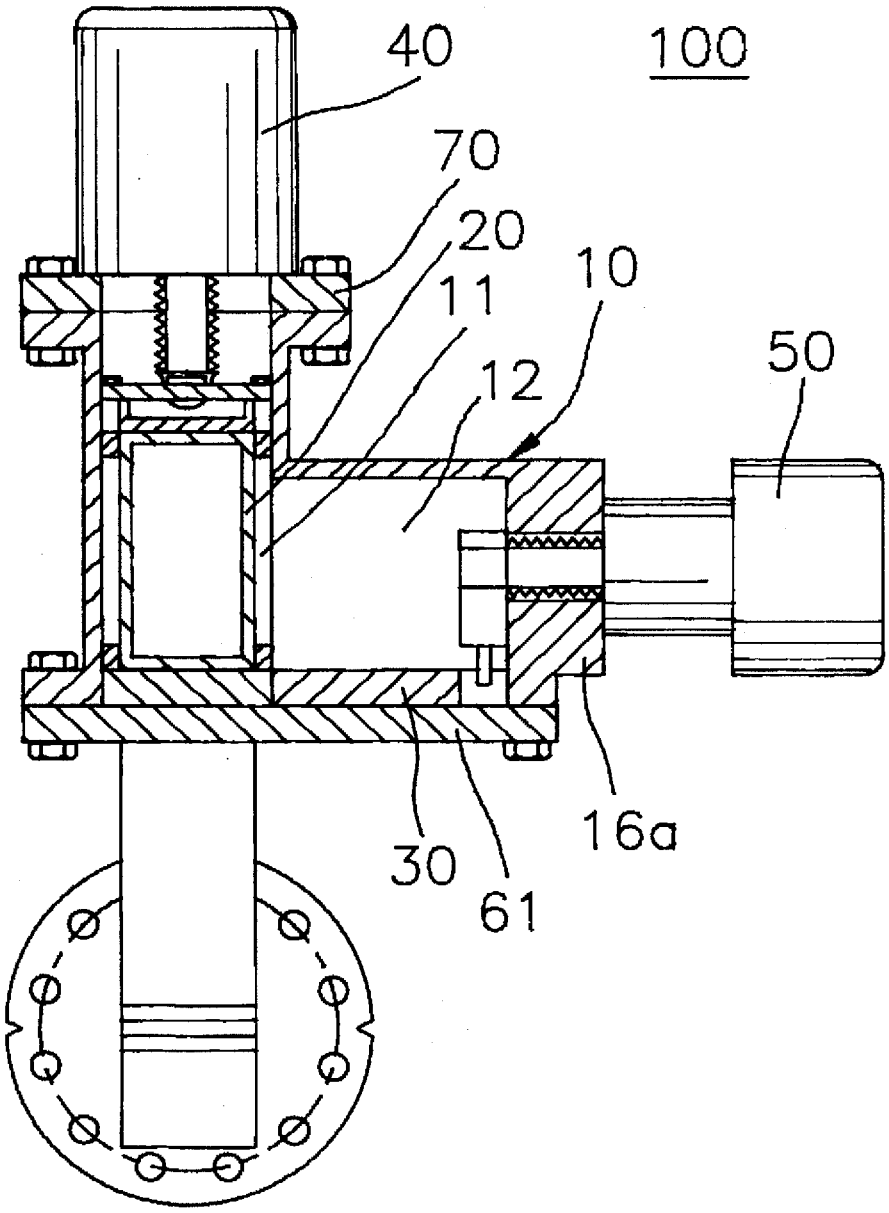
Figure 1C:
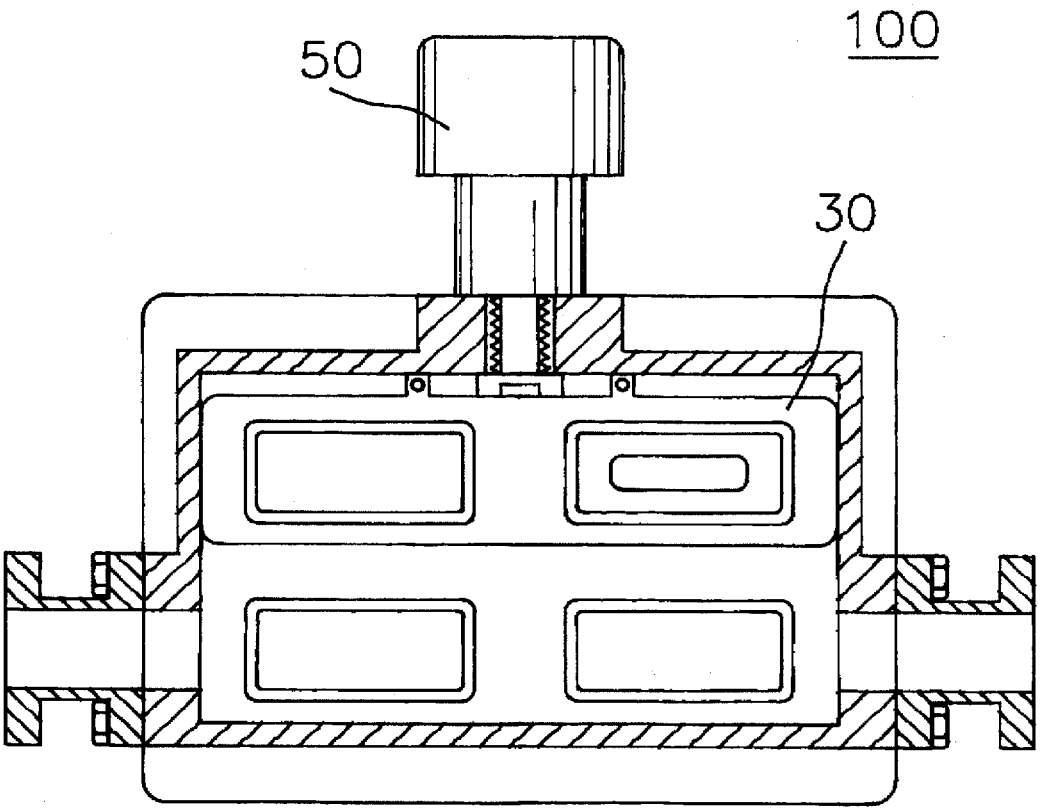

Referring to FIGS. 1A, 1B and 1C, there are, respectively, shown a sectional front view, a sectional side view and a sectional top view of an inventive waveguide valve 100, when a high power radio frequency ("RF") is applied thereto.

The waveguide valve 100 includes an L-shaped vacuum chamber 10, a U-shaped waveguide 20, a sealing plate 30, a first and a second linear motion drivers 40, 50, a dual H-corners assembly 60 and a plate 70.

Figure 2A:
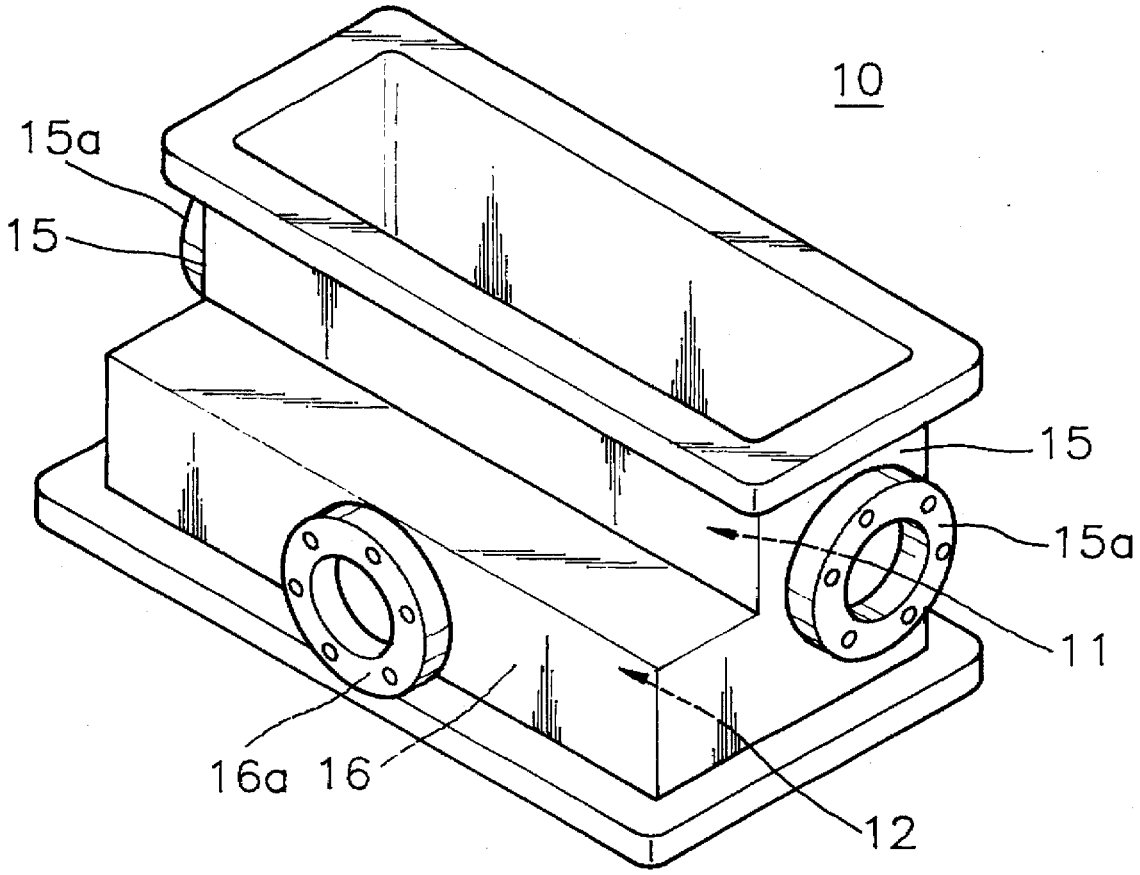
FIGS. 2A and 2B illustrate a perspective view and a rear view of the L-shaped vacuum chamber, respectively.
Figure 2B:
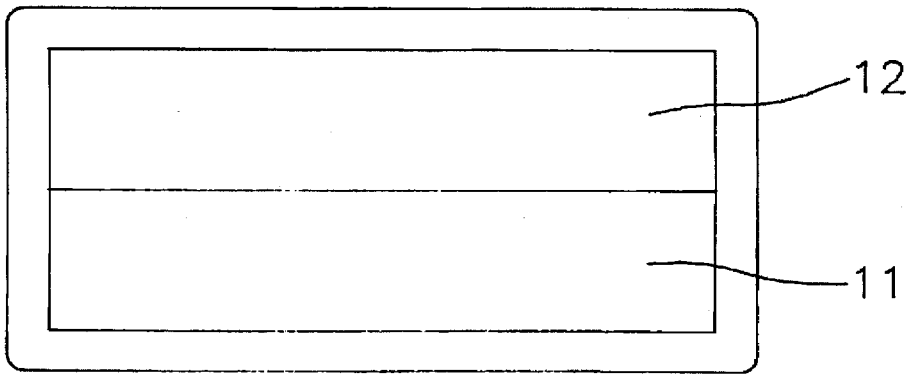

The L-shaped vacuum chamber 10 is divided into a first section 11 for the U-shaped waveguide 20 and a second section 12 for garaging the sealing plate 30, as shown in FIGS. 2A and 2B. The L-shaped vacuum chamber 10 has a pair of side surfaces 15, 15 of the first section 11 thereof and a front surface 16 of the second section 12 thereof. The side and the front surfaces 15, 16 are, respectively, provided with each of the ports 15*a*, 16*a*. The port 15*a* is used for attaching a flange 17, as shown in FIG. 1A, and the port 16*a* is used for installing the second linear motion driver 50, as shown in FIG. 1B. Furthermore, the plate 70 provided with the first linear motion driver 40 covers the top of the L-shaped vacuum chamber 10, as shown in FIGS. 1A and 2A.

Figure 3:
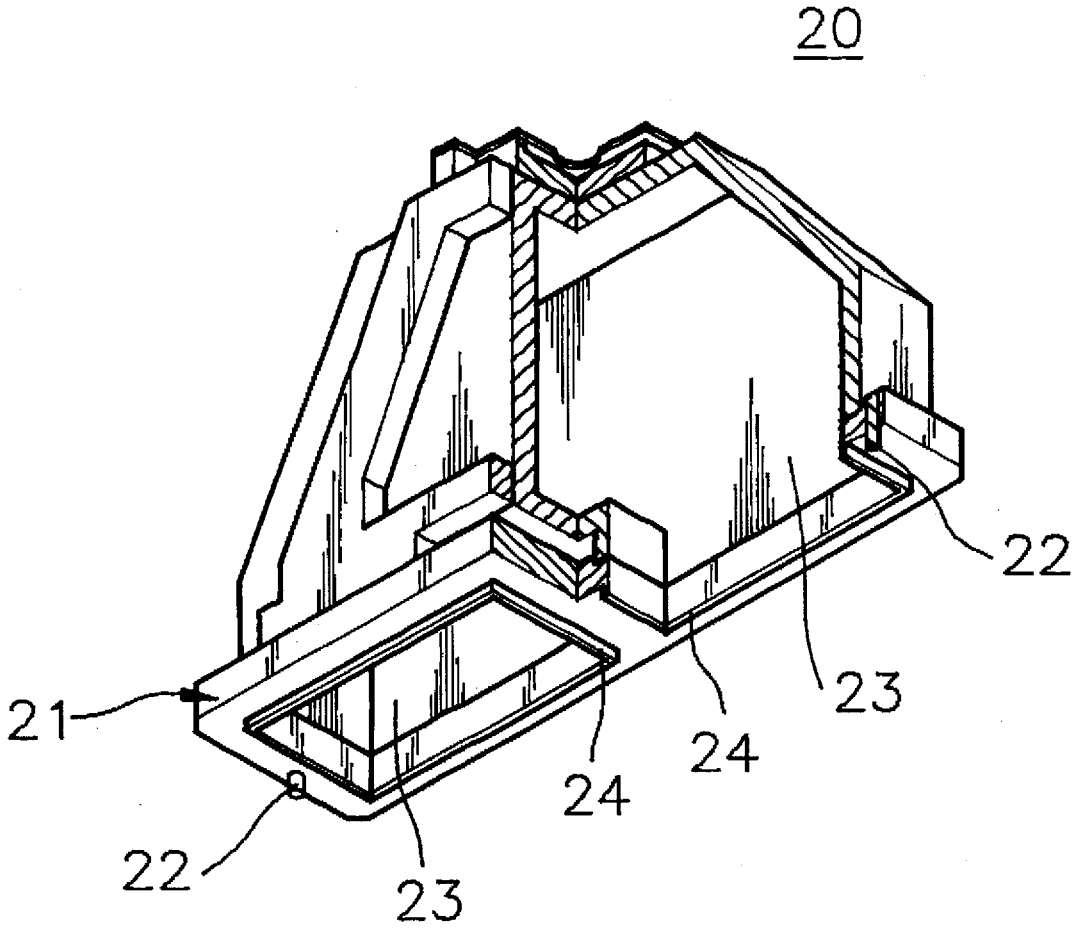
FIG. 3 offers a partial cutaway perspective view of the U-shaped waveguide.

As shown in FIG. 3, the U-shaped waveguide 20 has a connection plate 21. The connection plate 21 is provided with a pair of position determining pins 22, 22, each of which is located at a center of an end of a bottom surface thereof, and a pair of rectangular holes 23, 23 between the position determining pins 22, 22. The rectangular hole 23 has a protruded edge 24. This U-shaped waveguide 20 is installed at the first section 11 of the L-shaped vacuum chamber 10 in such a way that is vertically moved by the first linear motion driver 40 as shown in FIG. 1B.

Figure 4:
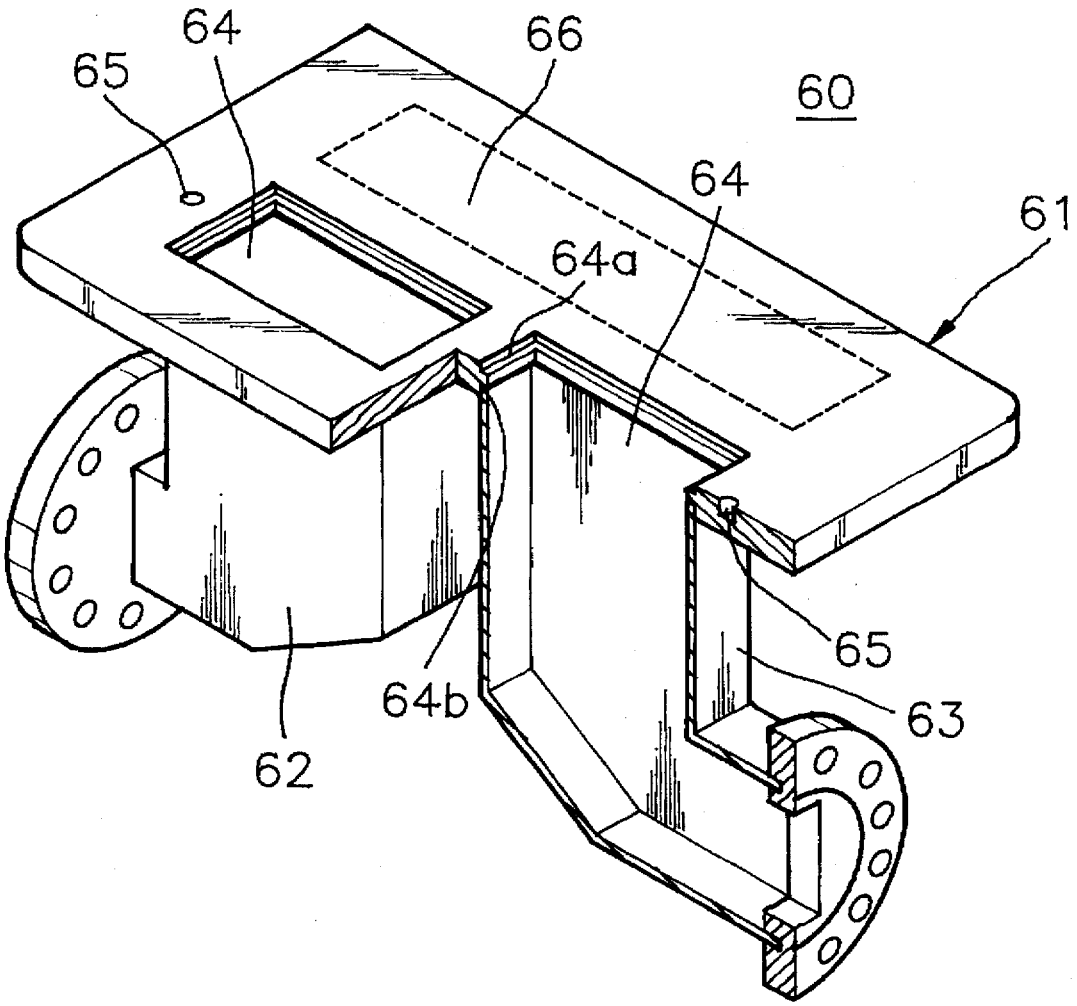
FIG. 4 presents a partial cutaway view of the dual H-corners assembly.

As shown in FIG. 4, the dual H-corners assembly 60 has a connection plate 61 for covering the bottom of the L-shaped vacuum chamber 10 and a pair of L-shaped waveguides 62, 63 for inputting and outputting RF. The dual H-corners assembly connection plate 61 is provided with a pair of rectangular holes 64, 64 for communication between the U-shaped waveguide 20 and each of the L-shaped RF input and output tubes waveguides 62, 63, a pair of notches 65, 65 for accommodating its corresponding position determining pins 22, 22 of U-shaped waveguide 20, and a position 66 indicated by a dotted line for garaging the sealing plate 30. The dual H-corners assembly rectangular hole 64 is provided with an upper step edge 64*a* for accommodating its corresponding U-shaped waveguide protruded edge 24 and a lower step edge 64*b* for accommodating one end part of the RF input or output tubes waveguides 62 or 63. Furthermore, the upper step edge 64*a* is provided with a rectangular step gasket 67 for preventing an electrical short between the U-shaped waveguide 20 and the dual H-corners assembly 60. Each of the RF input and output waveguides 62, 63 joined to each of the lower step edges 64*b*, 64*b* is, at its other end part, provided with a flange for attaching an adjacent flange (not shown).

Figure 5A:
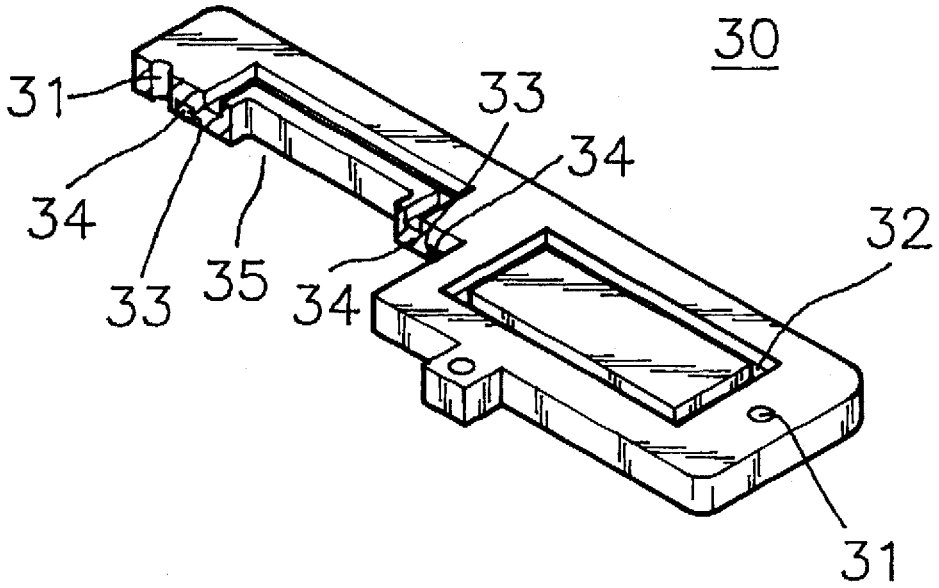
FIGS. 5A and 5B depict a partial cutaway view and a rear view of the sealing plate, respectively.
Figure 5B:
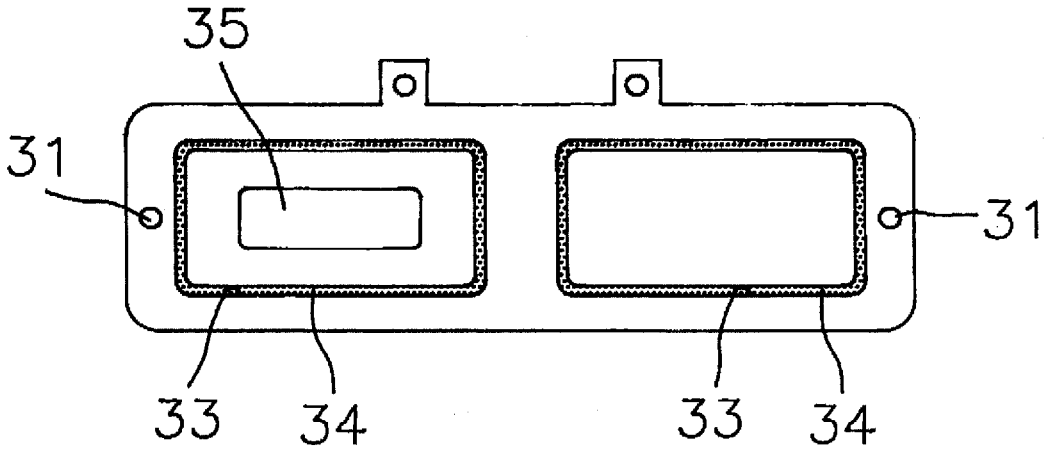

Meanwhile, the sealing plate 30 for selectively sealing the dual H-corners assembly rectangular hole 64 corresponding to the RF input waveguide 62 is mounted on the garage position 66 of the dual H-corners assembly connection plate 61 in such a way that it is allowed to horizontally slide by the second linear motion driver 50, as shown in FIG. 1B. As shown in FIGS. 5A and 5B, the sealing plate 30 is provided with a pair of through holes 31, 31 for accommodating the corresponding position determining pins 22, 22 of the U-shaped waveguide 20, and on its top surface, with a pair of rectangular grooves 32, 32 for accommodating the corresponding protruded edges 24, 24 of the U-shaped waveguide 20. The sealing plate 30 is, further, provided with a pair of closed trapezium grooves 33, 33 on its bottom surface, each of which is wider and longer than the rectangular hole 64 on its top surface. The trapezium groove 33 is provided with a VITON O-ring 34 to keep airtightness between the sealing plate 30 and each of the input and the output waveguides 62, 63. In addition, the sealing plate 30 has an aperture 35 for balancing the vacuum in the U-shaped waveguide 20 in the rectangular groove 32 corresponding to the RF output waveguide 63.

Figure 6A:
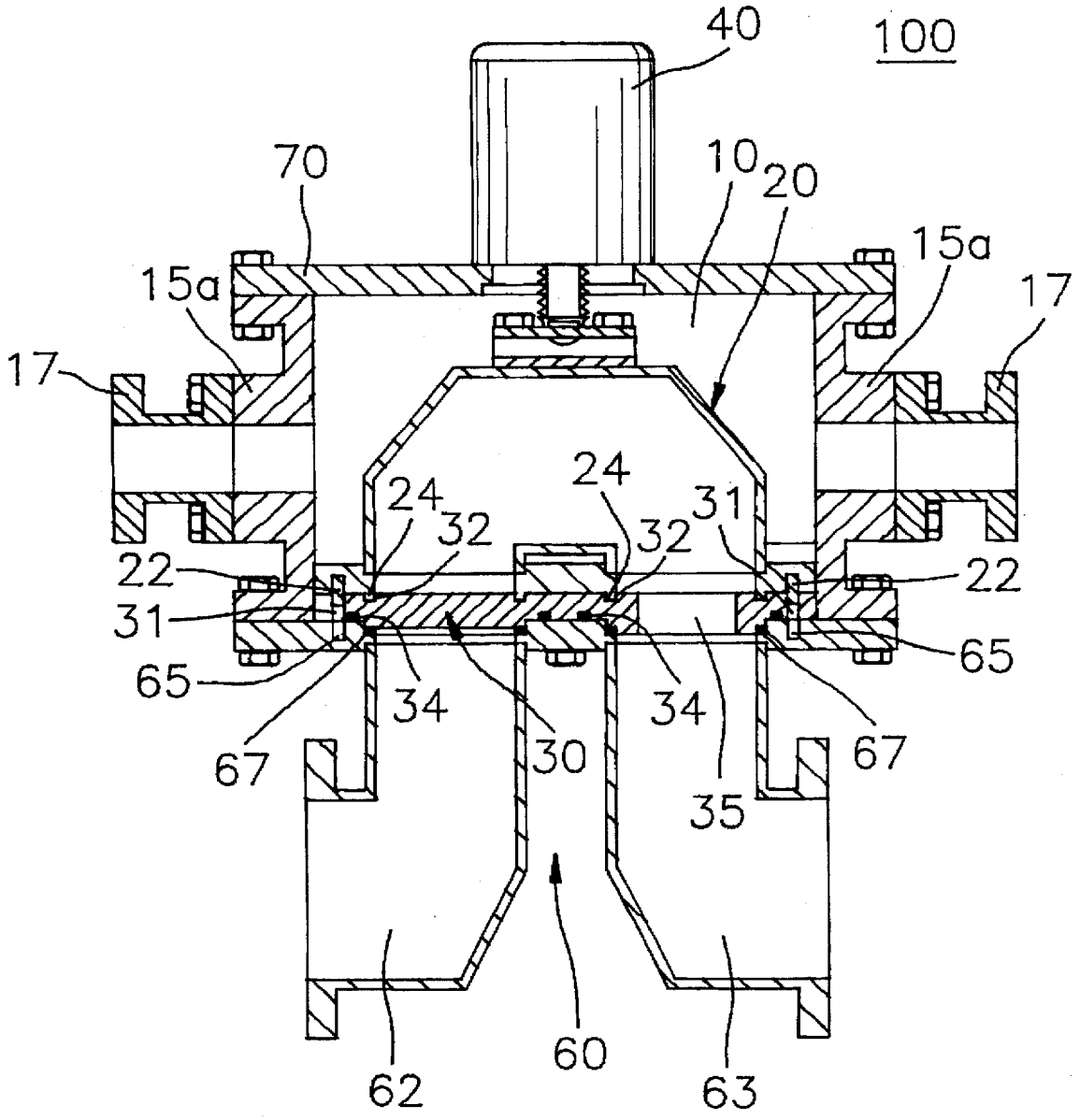
FIGS. 6A, 6B and 6C display a sectional front view, a sectional side view and a sectional top view of the inventive waveguide valve, respectively, when the high power radio frequency is not applied thereto.
Figure 6B:
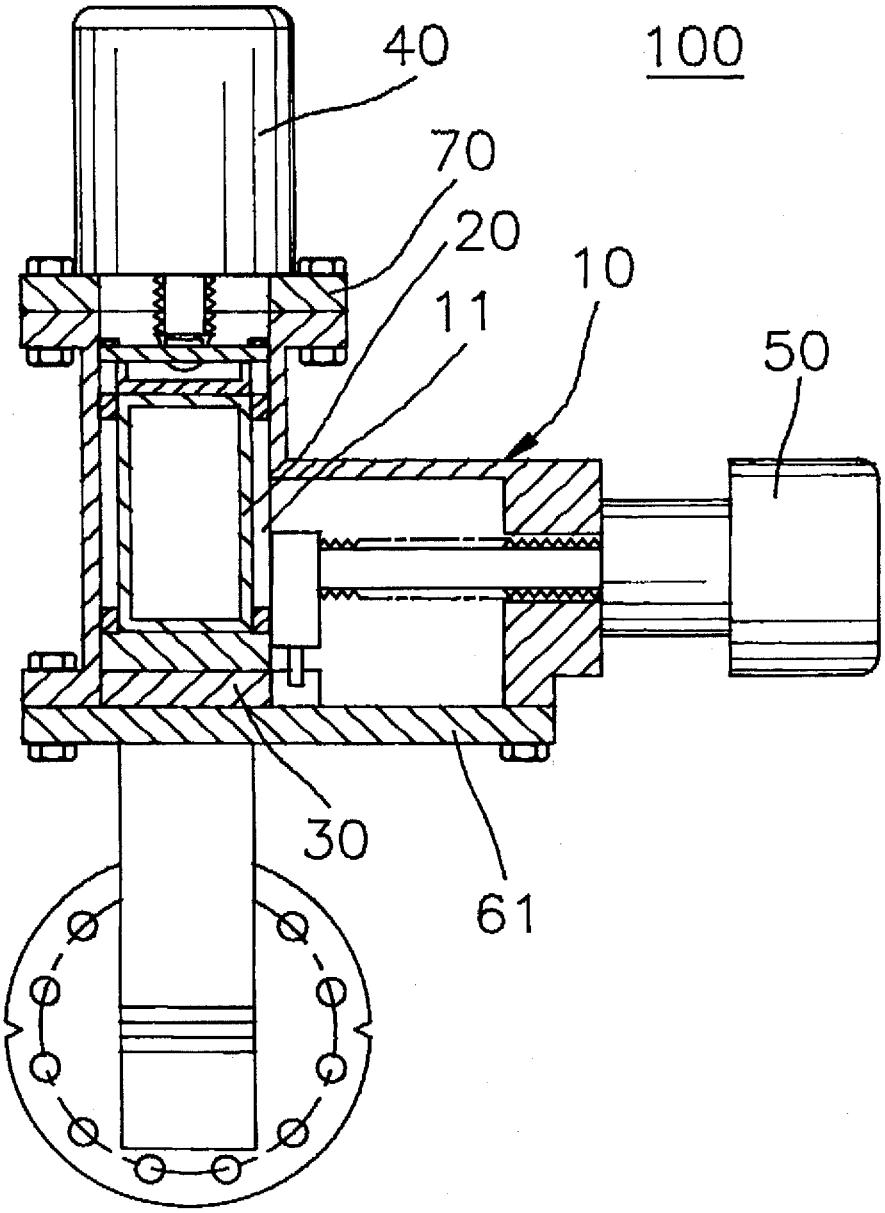
Figure 6C:
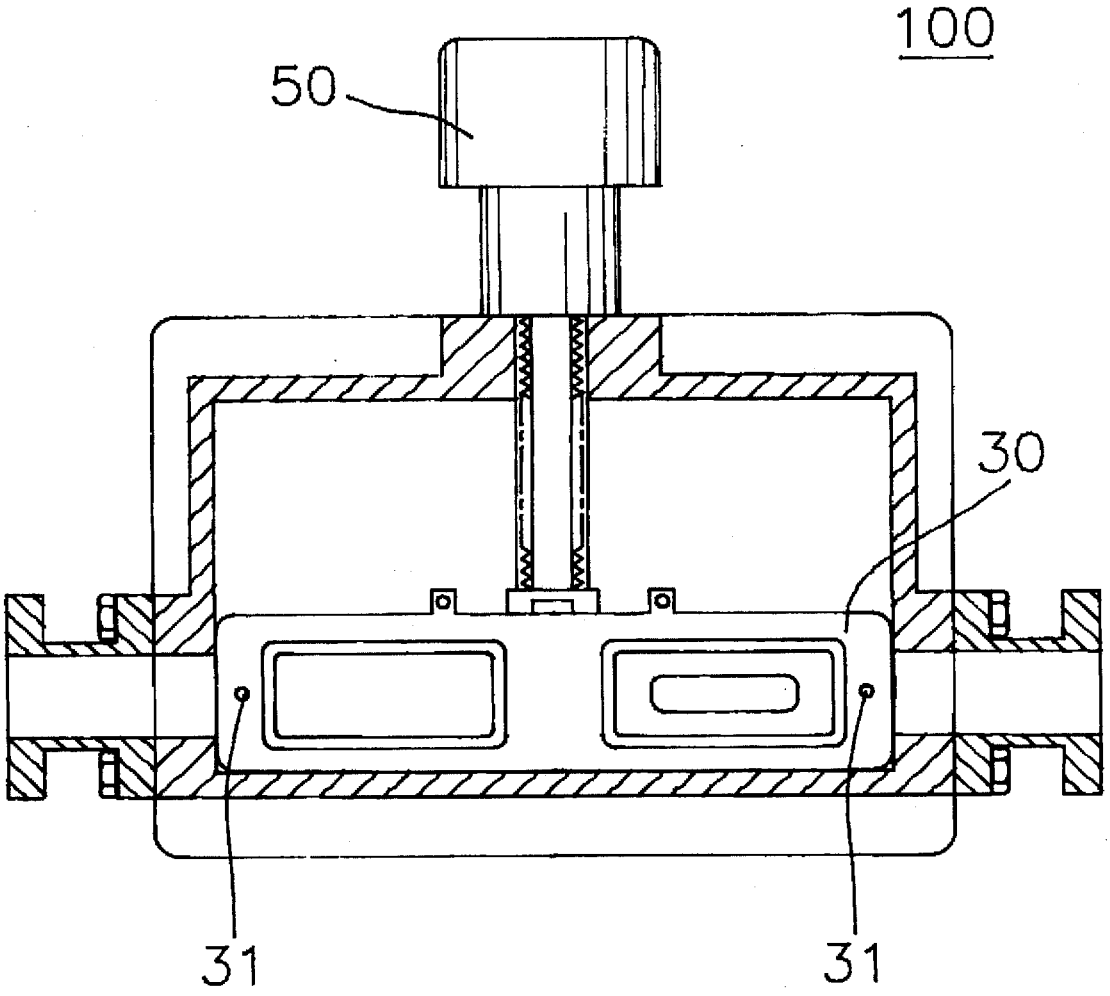

Referring to FIGS. 6A to 6C, when it is required that the high power RF is sealed, the U-shaped waveguide 20 is moved upwardly by the first linear motion driver 40 to prepare a separation for the sealing plate 30. At the same time, the sealing plate 30 on the garaging position 66 of the dual H-corners assembly connection plate 61 slides toward the dual H-corners assembly rectangular holes 64, 64 by means of the second linear motion driver 50 as, shown in FIGS. 6B and 6C in such a way that its through hole 31 is aligned with the corresponding notch 65 of the dual H-corners assembly 60, to thereby seal the RF input waveguide 62. Then, the U-shaped waveguide 20 is downwardly moved by the first linear motion driver 40 in such a way that its position determining pins 22 and protruded edge 24 are, respectively, fitted into the corresponding sealing plate through hole 31 and sealing plate rectangular groove 32 to press the sealing plate 30. Each of the VITON O-rings 34, 34 provided on the bottom surface of the sealing plate 30 surrounds each of the RF input and output waveguides 62, 63, keeping the airtight therebetween. Furthermore, since the sealing plate 30 is provided with the aperture 35, the vacuum balancing in the U-shaped waveguide is kept.

On the other hand, returning to FIGS. 1A to 5C, when the high power RF is applied, the U-shaped waveguide 20 is moved upwardly by the first linear motion driver 40 and the sealing plate 30 comes back to the garaging position 66. Then, the U-shaped waveguide 20 is downwardly moved by the first linear motion driver 40 in such a way that its position determining pin 22 is fitted into the corresponding notch 65 and its protruded edge 24 matches the corresponding upper step edge 64*a* of the dual H-corners assembly connection plate 61. Since the upper step edge 64*a* of the dual H-corners assembly rectangular hole 64 is provided with the rectangular step gasket 67, it is possible to connect the U-shaped waveguide 20 with the dual H-corners assembly 60 without causing an electrical short. Under this condition, the high power RF input through the waveguide 62 is transmitted to the waveguide 63 via the U-shaped waveguide 20.

In such a waveguide valve, it is possible to transmit or seal the 80 MW or more power without causing its breakdown during a high power operation.

Although the invention has been shown and described with respect to the preferred embodiments, it will be understood by those skilled in the art that various changes and modifications may be made without departing from the scope of the invention as defined in the following claims.

What is claimed is:

1. A waveguide valve comprising:

an L-shaped vacuum chamber;

a plate for covering the top of the L-shaped vacuum chamber;

a first linear motion driver provided on the covering plate;

a U-shaped waveguide being provided in the L-shaped vacuum chamber in such a way that it is allowed to vertically slide by the first linear motion driver and having a connection plate provided with a pair of rectangular holes;

a dual H-corners assembly having a connection plate provided with a pair of rectangular holes, each of the rectangular holes having an upper and a lower step edges, and a pair of waveguides for inputting and outputting radio frequency, each of the waveguides being joined to each of the lower step edges so as to be integrally formed with the dual H-corners assembly connection plate, the dual H-corners assembly connection plate covering the bottom of the L-shaped vacuum chamber in such a way that its rectangular holes are aligned with the corresponding U-shaped waveguide rectangular holes;

a sealing plate for selectively sealing the L-shaped radio frequency input and output waveguides, the sealing plate being mounted on the dual H-corners assembly connection plate in such a way that it is allowed to horizontally slide; and a second linear motion driver being provided with the L-shape vacuum chamber so as to horizontally slide the sealing plate.

2. The waveguide valve of claim 1, wherein the U-shaped waveguide connection plate is further provided with a pair of position determining pins, each of which is located at a center of an end of its bottom surface, the dual H-corners assembly is further provided with a pair of notches in such a way that it is allowed to accommodate the corresponding position determining pins, and the sealing plate is provided with a pair of through holes for accommodating its corresponding position determining pins.

3. The waveguide valve of claim 1, wherein the U-shaped waveguide rectangular hole has a protruded edge for matching the upper step edge of the dual H-corners assembly rectangular hole.

4. The waveguide valve of claim 3, wherein the sealing plate is, on its top surface, provided with a pair of rectangular grooves for accommodating the corresponding protruded edges of the U-shaped waveguide rectangular holes.

5. The waveguide valve of claim 1, wherein the upper step edge is provided with a rectangular step gasket.

6. The waveguide valve of claim 1, wherein the sealing plate is further provided with an aperture.

7. The waveguide valve of claim 1, wherein the sealing plate is further provided with a pair of trapezium grooves.

8. The waveguide valve of claim 7, wherein the trapezium groove is provided with an O-ring.

* * * * *